US006047400A

United States Patent [19]

Spencer

[11] Patent Number: 6,047,400

[45] Date of Patent: Apr. 11, 2000

[54] PIVOTABLE, DETACHABLE FACE MASK

[76] Inventor: James E. Spencer, 7914 Gilmore, Las Vegas, Nev. 89129

[21] Appl. No.: 09/111,044

[22] Filed: Jul. 7, 1998

[51] Int. Cl.[7] ..... A41D 13/00

[52] U.S. Cl. ..... 2/9; 2/424; 2/425

[58] Field of Search ..... 2/9, 10, 15, 424, 2/425; D2/865, 891, 892; D21/788

[56] References Cited

U.S. PATENT DOCUMENTS

| | | | |
|---|---|---|---|
| 2,908,911 | 10/1959 | Sowle | 2/9 |
| 3,984,875 | 10/1976 | Farquharson | 2/10 |
| 4,233,687 | 11/1980 | Lancellotti | 2/9 |
| 4,271,537 | 6/1981 | Bowlus et al. | 2/424 |
| 4,363,140 | 12/1982 | Correale | 2/9 |
| 4,774,729 | 10/1988 | Coates et al. | 2/424 |
| 4,885,807 | 12/1989 | Snow, Jr. | 2/424 |
| 4,933,993 | 6/1990 | McClelland | 2/424 |
| 4,947,490 | 8/1990 | Hayden | 2/424 |
| 4,985,938 | 1/1991 | Snow, Jr. | 2/424 |
| 5,084,918 | 2/1992 | Breining et al. | 2/424 |
| 5,095,552 | 3/1992 | Parkinson | 2/424 |
| 5,129,108 | 7/1992 | Copeland et al. | 2/424 |
| 5,263,204 | 11/1993 | Butsch | 2/424 |
| 5,448,780 | 9/1995 | Gath | 2/424 |
| 5,502,843 | 4/1996 | Strickland | 2/424 |
| 5,619,755 | 4/1997 | Casartelli | 2/424 |

*Primary Examiner*—John J. Calvert
*Assistant Examiner*—Gary L. Welch
*Attorney, Agent, or Firm*—Kenneth L. Tolar

[57] ABSTRACT

A detachable face mask assembly for a helmet includes upper and lower mask assemblies removably secured over the helmet face opening with a series of clips. The upper mask assembly includes a first outer component and a first inner component concentrically received therewithin. The inner component may be pivoted upwardly or laterally to provide temporary access to a user's eyes or nose. The lower mask assembly likewise includes a second inner and a second outer component with the inner component pivotable to either side to provide temporary access to a user's mouth or chin. Each of the components are readily and independently detachable from their respective clips upon a predetermined amount of force being applied thereto.

12 Claims, 1 Drawing Sheet

PIVOTABLE, DETACHABLE FACE MASK

BACKGROUND OF THE INVENTION

The present invention relates to a detachable face mask assembly for a football helmet designed to minimize neck injuries.

DESCRIPTION OF THE PRIOR ART

A conventional football helmet typically includes a face opening covered with a protective mask that is permanently secured to the helmet. The face mask is often grasped by another player causing the head to twist relative to the player's body. Such a twisting motion can result in serious cervical injuries.

In addition, when wearing the helmet, a player has difficulty consuming liquids, wiping the eyes or performing similar tasks unless the helmet is removed. Furthermore, a player in certain situations may wish to use various style masks depending upon the position being played. For example, a lineman requires a mask having a plurality of compact, multi-directional bars to protect the face since playing such a position results in repeated contact. On the other hand, a place kicker only needs one or two bars since the kicker is rarely involved in a collision and the kicker needs a clearer field of vision. Accordingly, there is currently a need for a football helmet face mask that separates from the helmet upon a predetermined amount of force being applied thereto and which has a plurality of independently detachable components allowing a user to selectively configure the mask.

Various face mask assemblies exist in the prior art. For example, U.S. Pat. No. 5,502,843 issued to Strickland relates to a helmet having a face mask releasably attached to the helmet with a plurality of adjustable fasteners. Each fastener includes a mounting plate with a fixed section of hook and loop material thereon. The plate further includes a cooperating section of hook and loop material at one end that is adapted to extend around a face mask receiving groove and into contact with the fixed section of hook and loop material.

U.S. Pat. No. 5,095,552 issued to Parkinson discloses a helmet face guard mount including a thin, elongated resilient pad having a curved configuration dimensioned for securement between an ear hole and a forward side of a conventional football helmet. The pad has a strap for receiving a side bar of a face mask that allows the pad and strap to shift within the physical elastic limits thereof.

U.S. Pat. No. 5,084,918 issued to Breining et al discloses an integral safety helmet having a chin guard which may be folded upwardly or released.

U.S. Pat. No. 4,985,938 issued to Snow, Jr. discloses a face mask attached to the side and forehead portions of a helmet. The attachment means includes a plurality of posts on each side of the helmet and a ball and socket connection in the forehead area. The face mask includes brackets which are coupled with the posts in a releasable manner.

U.S. Pat. No. 4,947,490 issued to Hayden discloses a football helmet with a breakaway face mask including a seat on each side of the helmet. The seats have a hook and loop fastener on the exterior thereof. The face mask has an attachment plate on each side with a cooperating hook and loop fastener thereon. An abutment member is immediately adjacent the plate and seat to prevent movement of the mask in response to a force applied directly towards a user's face.

U.S. Pat. No. 4,885,807 issued to Snow, Jr. discloses a quick release face mask for use with contact sports helmets similar to that described in Snow, Jr., supra.

U.S. Pat. No. 4,774,729 issued to Coates et al discloses three snap in attachments including a plastic clip fastened to a helmet and formed with an elongated aperture adapted to receive the bottom of a U-shaped face mask bar.

Although various removable face masks exist in the prior art, none relate to a variably configurable device according to the present invention. The present invention provides an upper and a lower face mask assembly each comprising an outer and inner component which are independently detachable from the helmet. Accordingly, any combination of the components may be attached allowing a user to selectively configure the mask. When the inner mask components are in use, either may be easily pivoted away from the face opening to allow temporary access to the user's eyes, nose or mouth.

SUMMARY OF THE INVENTION

The present invention relates to a detachable face mask assembly for a football helmet. The device comprises a helmet including a hollow protective shell for receiving a user's head having a pair of opposing side edges and a top edge that define a face opening. Adjacent the side and top edges are a plurality of juxtaposed pairs of clips for retaining an upper and lower face mask assembly. Each mask assembly includes an outer component and an inner component concentrically received therein, each of which are independently attachable to a pre-designated number of clips. Each of the mask components may also be pivoted away from the face opening providing temporary access to a wearer's face. Accordingly, a user may selectively configure a face mask using any combination of components each of which will be detached from the helmet upon receiving a predetermined amount of force. It is therefore an object of the present invention to provide a detachable face mask assembly in which the configuration may be selectively varied.

It is yet another object of the present invention to provide a detachable face mask assembly including a plurality of upper and lower mask members each of which are independently detachable and pivotable relative to the others.

It is yet another object of the present invention to provide a detachable face mask assembly having pivotable sections which allow temporary access to the user's face without removing the helmet. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
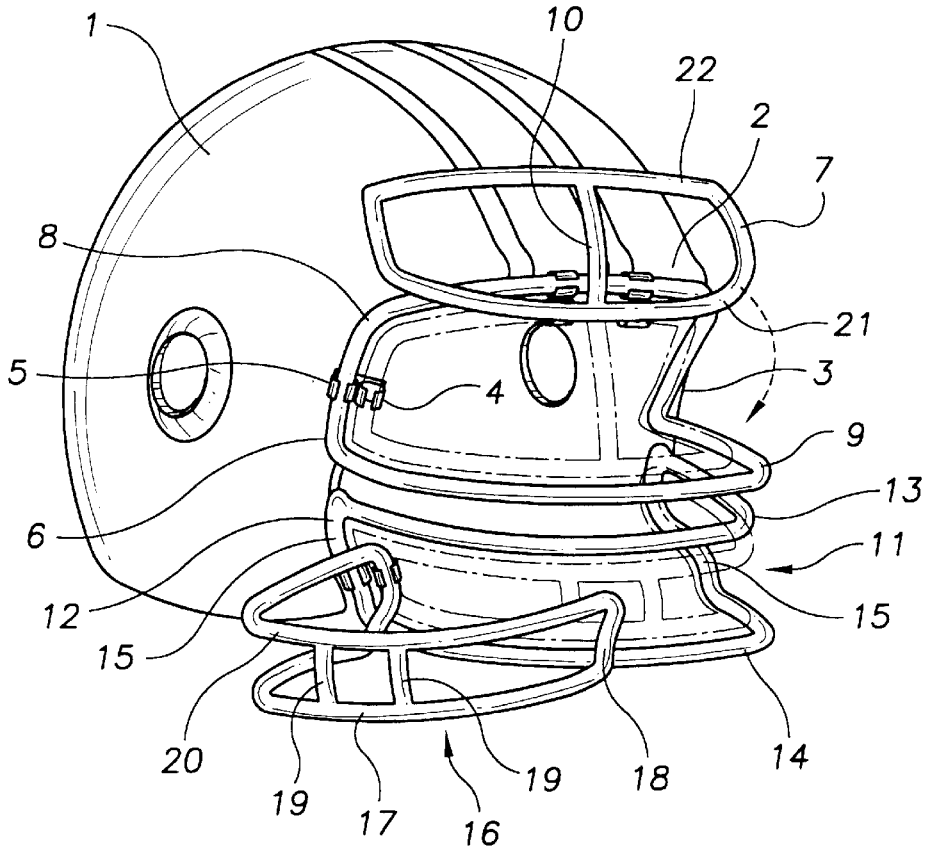
FIG. 1 depicts the inventive device attached to a helmet with the first and second inner components pivoted away from the helmet face opening.
Figure 2:
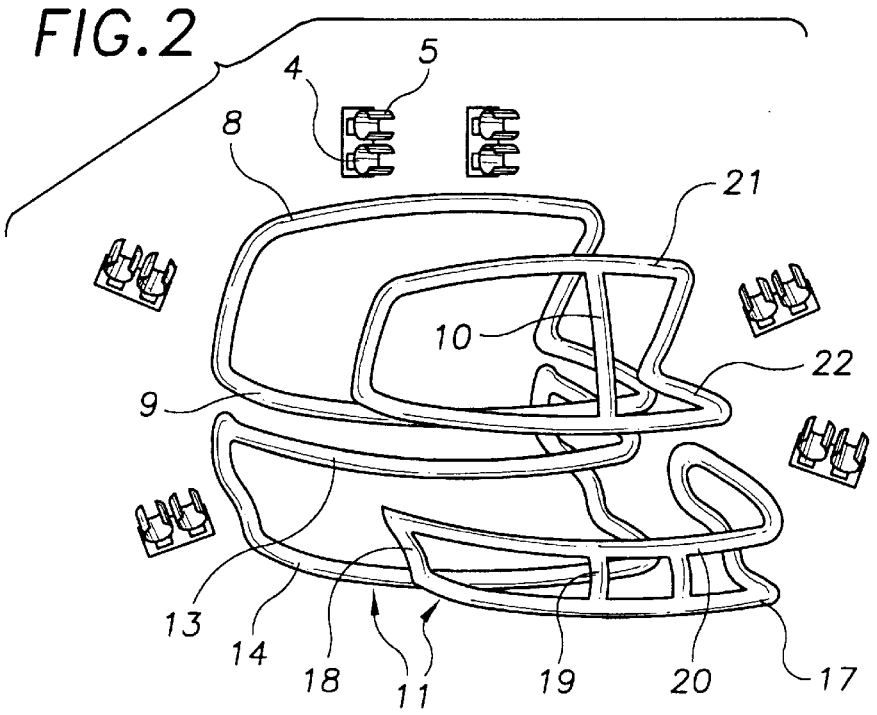
FIG. 2 is a partially exploded view of the detachable face mask assembly.

Referring now to FIGS. 1 and 2, the present invention relates to a helmet having a detachable face mask. A football helmet includes a hollow protective shell 1 for encompassing a user's head having a top edge 2 and a pair of side edges 3 integrally depending therefrom, the area between the top edge and side edges defining a face opening. A plurality of juxtaposed pairs of clips are adjacent the side and top edges for receiving various face mask components as described below. Each pair of clips includes an internally 4 and externally 5 disposed clip.

The face mask for a helmet as described above includes an upper mask assembly and a lower mask assembly. The upper mask assembly includes a first outer component 6 and a first inner component 7 concentrically disposed therewithin. The outer component 6 includes an upper, substantially vertical U-shaped bar 8 that borders the top and side edges of the helmet when attached thereto and a semi-circular substantially horizontal face guard 9 outwardly extending therefrom. The outer component is removably secured to the helmet by inserting the U-shaped bar into a predetermined number of the externally disposed clips along the top and side edges.

The inner component 7 has a similar configuration to that of the outer component and is disposed within the U-shaped bar and face guard. The inner component includes a substantially vertical, U-shaped bar 21 and a semi-circular substantially horizontal face guard 22 outwardly extending therefrom. The inner component also includes a vertical, substantially centrally disposed nose guard 10 extending from its U-shaped portion to its face guard. The inner component is secured to the helmet in a similar manner as the upper component using a plurality of the internally disposed clips.

The device also includes a lower mask assembly 11 including a second outer component 12 having upper 13 and lower 14 vertically aligned, substantially U-shaped mouth guards with a pair of vertical side bars 15 disposed therebetween. Each vertical side bar may be removably received within an externally disposed clip.

A second inner component 16 is dimensioned to concentrically fit between the upper and lower mouth guards. The second inner component includes upper 20 and lower 17 U-shaped rods with a pair of side members 18 and a pair of centrally disposed vertical cross members 19 therebetween. The second inner component side members 18 are each snapped into an internally disposed clip to secure the component to the helmet.

Any combination of the mask components may be attached to their respective clips to create a face mask having a desired configuration. If all four components are secured to the helmet, the first inner component may be displaced from its respective side clips and pivoted upwardly providing temporary access to the user's eyes or nose or it may be displaced from its top clips and a side clip and pivoted outwardly. The second inner component may be detached from either of its respective side clips and pivoted outwardly toward the opposing side providing temporary access to the user's mouth or chin. Regardless of the configuration, each of the mask components will detach from the helmet upon the application of a predetermined amount of force.

Preferably, the upper and lower mask assemblies are manufactured from high impact plastic or a suitable equivalent. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A helmet having a detachable face mask comprising:

a hollow helmet member for surrounding a user's head, said helmet having a pair of opposing side edges and an upper edge therebetween all of which define a face opening;

an upper face mask assembly having means for releasable attachment to said helmet, said upper face mask assembly covering an upper portion of said face opening;

a lower face mask assembly having means for releasable attachment to said helmet independently of said upper mask assembly covering a lower portion of said face opening, said upper and lower face mask assemblies separating from said helmet upon the application of a predetermined amount of force thereto.

2. A device according to claim 1 wherein said upper face mask assembly includes a first outer component with a first inner component concentrically received therewithin, each of said inner and outer components independently releasable from said helmet.

3. A device according to claim 2 wherein the first inner mask component is upwardly pivotable to provide temporary access to a user's face.

4. A device according to claim 2 wherein said first outer component further includes an upper, substantially vertical U-shaped bar that borders the top and side edges of said helmet when attached thereto.

5. A device according to claim 4 wherein said first outer component further includes a semi-circular face guard horizontally extending therefrom.

6. A device according to claim 2 wherein said first inner component includes an upper substantially U-shaped bar that borders the top and side edges of said helmet when attached thereto.

7. A device according to claim 6 wherein said first and inner component further includes a semi-circular face guard extending horizontally therefrom with a substantially vertical nose guard extending from said U-shaped bar to said face guard.

8. A device according to claim 2 wherein said lower mask assembly includes a second outer component with a second inner component concentrically received therewithin, each of said second inner and outer components independently releasable from said helmet.

9. A device according to claim 8 wherein the first and second inner components are laterally pivotable towards a side edge of said helmet and away from the face opening to provide temporary access to a user's face.

10. A device according to claim 8 wherein said second outer component includes upper and lower U-shaped mouth guards with a pair of vertical side bars disposed therebetween.

11. A device according to claim 8 wherein said second inner component includes upper and lower U-shaped rods with a plurality of side members and vertical cross members therebetween.

12. A device according to claim 1 wherein said upper and lower mask assemblies are removably secured to said helmet with a plurality of juxtaposed pairs of clips immediately adjacent the top and side edges thereof, each pair including an externally disposed clip for receiving a portion of an outer component and an internally disposed clip for receiving a portion of an inner component.

* * * * *